United States Patent [19]

Mohr et al.

[11] 4,201,624

[45] May 6, 1980

[54] EXTENDED NIP PRESS

[75] Inventors: William C. Mohr, Rockford; Leroy H. Busker, Rockton; Carl J. Francik, Roscoe, all of Ill.; Jan I. Bergstrom, Beloit, Wis.

[73] Assignee: Beloit Corporation, Beloit, Wis.

[21] Appl. No.: 939,449

[22] Filed: Sep. 5, 1978

[51] Int. Cl.[2] ..... D21F 3/04; D21F 3/06

[52] U.S. Cl. ..... 162/205; 162/305; 162/360 R

[58] Field of Search ..... 162/205, 305, 358, 360 R; 100/37, 42, 118, 121, 153, 154, 156, 161

[56] References Cited

U.S. PATENT DOCUMENTS

| | | | |
|---|---|---|---|
| 2,319,214 | 5/1943 | Davies | 100/154 |
| 3,783,097 | 1/1974 | Justus | 162/358 |
| 3,970,515 | 7/1976 | Busker | 162/358 |
| 4,086,131 | 4/1978 | Rempel et al. | 162/205 X |

FOREIGN PATENT DOCUMENTS

| | | | |
|---|---|---|---|
| 452200 | 10/1948 | Canada | 162/205 |
| 79919 | 2/1971 | German Democratic Rep. | 162/358 |

*Primary Examiner*—Richard V. Fisher

*Attorney, Agent, or Firm*—Hill, Van Santen, Steadman, Chiara & Simpson

[57] ABSTRACT

A press mechanism and method for removing liquid from a traveling fibrous web such as in a paper making machine including first and second elongate extended press nips including an endless looped traveling belt passing over spaced guide rolls with first and second opposed press rolls pressed into the belt to form the extended nips between the press rolls and belt and opposed shoes within the belt pressing outwardly against the press rolls to form the extended nips with the shoes urged against the belt by opposed pistons having a liquid pressure chamber therebetween so that the reaction forces of the fluid on the pistons are cancelled with the web being carried through the nips on felts and following the belt between the nips.

17 Claims, 5 Drawing Figures

23
20a
21
19
N-2
12
25
II
13a
10a
33
32
46
42
13
41
47
14b
11
20
14
12a
12b
15
16
15b
16b
15a
16a
14a
11a
10
17
11b
37
45
38
40
39
35
18
43
36
34
44
II
19a
22
N-1
W
24

EXTENDED NIP PRESS

BACKGROUND OF THE INVENTION

The invention relates to an improved method and mechanism for pressing water from a traveling paper web, and more particularly to a press arrangement known as an extended press nip wherein the web is subjected to pressing pressures for a longer period of time than the usual arrangement wherein it passes between two opposed press rolls.

More particularly, the invention relates to a method and structure having first and second press nips wherein the residence time of the web in the nips is increased over that of a roll couple and wherein an improved structure is used to extract water from a web. Other structures have been provided heretofore which have attempted to increase the time over which a web is subjected to a pressure, and yet permit the web to continue movement at a speed necessary in a high speed paper making machine. Such structures have met with degrees of success and are exemplified by the disclosures of U.S. Pat. Nos. 3,748,225, Busker et al; 3,783,097, Justus; 3,797,384, Hoff; 3,798,121, Busker et al; 3,804,707, Mohr; 3,808,092, Busker; 3,808,096, Busker et al; 3,840,429, Busker et al; 3,853,698, Mohr. The devices and method discussed by these previous patents have taken advantage of the knowledge that the static application of mechanical pressure to wet paper mat can reduce the moisture content in the mat to below 40%. Under the dynamic short-term mechanical pressing which occurs in the usual paper machine where the web is run between a series of nips formed between press roll couples, it is often difficult to maintain moisture levels below 60%. Attempts to obtain increased dryness in the conventional roll-couples are usually made by increase in the press nip pressure, but a plateau is soon reached where major increases in roll loading result in relatively small decreases in moisture.

As is known, it is far more efficient to remove water in the press section of a paper machine than in the thermal dryer section and significant reduction in energy costs and significant reduction in the space needed for the dryer drum section of the machine are achieved for every fraction of a percent of moisture that can be additionally removed in the press section. The difficulty of removing moisture in the press section is increased with increase in machine speed because limiting factors are reached in press nip pressures in that compacting and crushing of the web results with higher nip pressures and resultant higher hydraulic pressures within the paper mat. The most feasible way that has been discovered to increase water removal at high speeds has been to increase the residence of pressure time to allow more time for flow to occur within the paper mat and for the hydraulic pressure to dissipate and for water to be pressed out of the web into the felt.

It is accordingly an object of the present invention to take advantage of the principles of extended nip pressing which increases the time that a web is subjected to pressing pressure and to provide an improved method and mechanism utilizing these principles which more effectively removes water from the web increasing the dryness of the web leaving the press section and reducing the possibility of crushing and improving the overall quality of the web formed in a paper making machine.

A further object of the invention is to provide a unique and improved extended nip press which is capable of being constructed for very wide paper machines reducing the problems of deflection of supporting rolls and other parts and insuring handling the web at high speed without distortion and breaking and with uniform pressing pressures being applied over the width of a very wide web.

A further object of the invention is to provide an improved press mechanism which is capable of removing a greater amount of water from a high speed traveling web and which requires less space for the structure than now necessary with existing press arrangements.

A further object of the invention is to provide an improved method and structure which permits a wet paper mat to be subject to mechanical pressing pressures for an extended period of time wherein the structure is well adapted to predetermination of desired nip length and nip pressures.

A feature of the invention is that the present arrangement employs an extended nip press concept wherein the pressing pressure on the wet web is immediately brought up to a predetermined optimum pressing pressure, and the pressure is maintained substantially constant throughout the length of the extended nip without change and then dropped off at the end of the nip. This arrangement avoids disadvantages of the conventional two roll press nips and of structures which have attempted to extend the length of a press nip, but do so by change in pressure throughout the length of the extended nip such as by having a continual pressure increase through a feed-in compression length and then a decrease in pressure over a decompression length such as taught, for example, by East German Pat. No. 79 919 published Nov. 12, 1971.

Other objects, advantages and features, as well as equivalent structures and methods which are intended to be covered herein, will become more apparent with the teaching of the principles of the invention in connection with the disclosure of the preferred embodiments thereof in the specification, claims and drawings, in which:

DRAWINGS

DESCRIPTION

Figure 1:
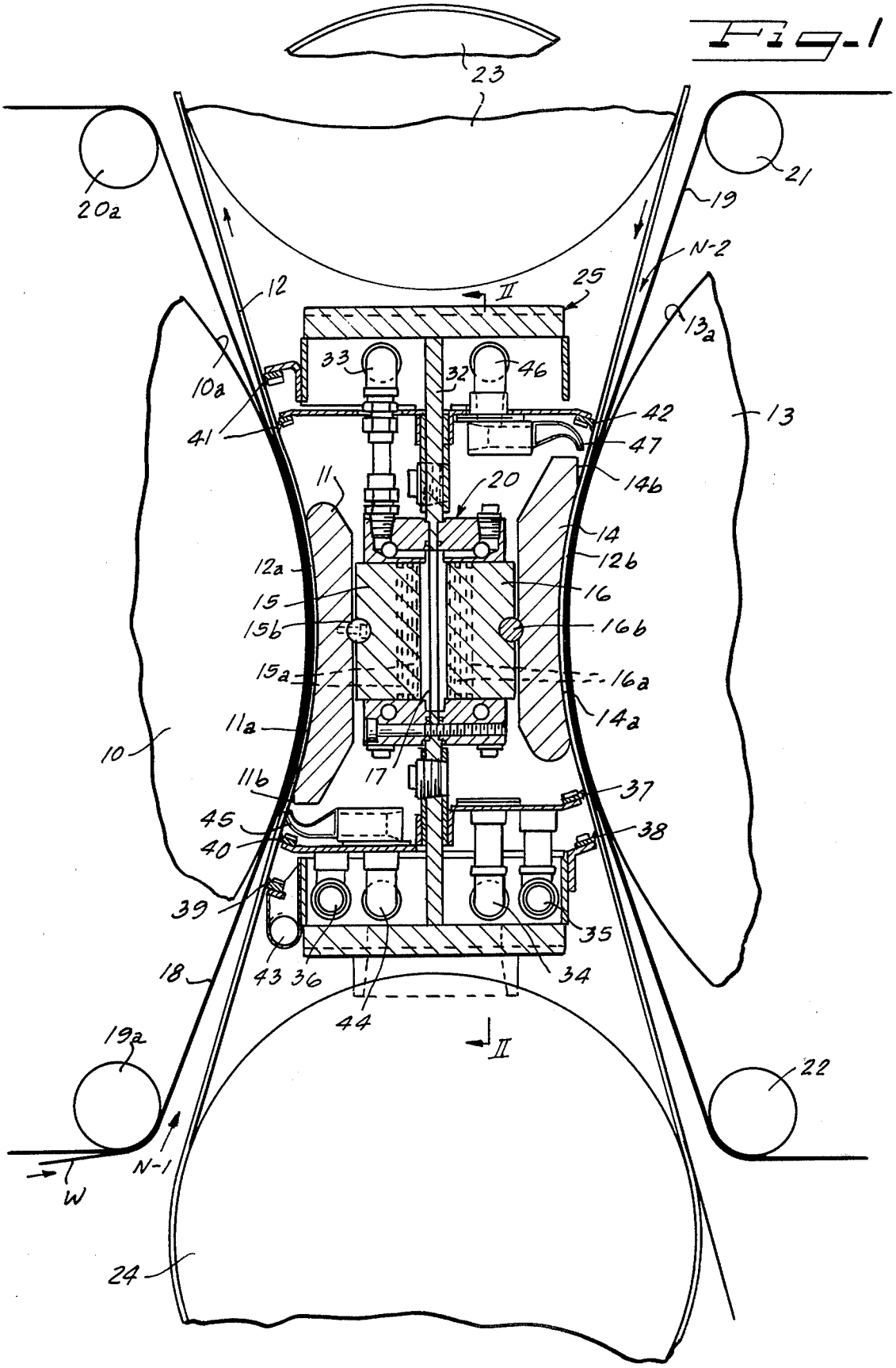
FIG. 1 is a front elevational view of a press section of a paper making machine embodying the principles of the present invention, with portions in vertical section.

As illustrated in FIG. 1, a wet traveling web W received from a forming surface is pressed in the extended nip arrangement illustrated by first passing into a nip N-1. The first elongate or extended press nip N-1 is formed between a traveling belt 12 and a first press surface 10 which is the outer surface of a rotating press roll. The nip N-1 is further formed by a first stationary backing member 11 in the form of elongated shoe urged against the inner surface of the belt 12 with a pressing force, and the water expressed from the web is received by a felt 18. The web follows the belt on the outgoing side of the nip and then enters a second nip N-2. The second nip is similar to the first including a second press surface which is the outer surface of a press roll 13. The nip N-2 is formed between the roll surface and the belt 12. A second stationary backing member is provided by a shoe 14 pressing against the belt and urging it toward the roll surface 13*a*. The rolls 10 and 13 press inwardly on the belt, and the shoes are pressed outwardly toward the belt by opposed pistons 15 and 16 which extend parallel to the rolls 10 and 13 along the nips and are pushed outwardly by force applying means in the form of pressurized fluid in the cylinder or chamber 17. The force of the fluid against the two pistons 15 and 16 is such that the reaction forces are equal and opposite and are cancelled so that there is no bending of the framework between the rolls 10 and 13. The rolls 10 and 13 may be of equal size so that they deflect outwardly an equal amount or, preferably they are controlled deflection rolls being constructed of a hollow roll shell with hydraulic pressure loaded shoes therein of a construction such as that disclosed in U.S. Pat. No. 3,276,102, Justus.

Figure 2:
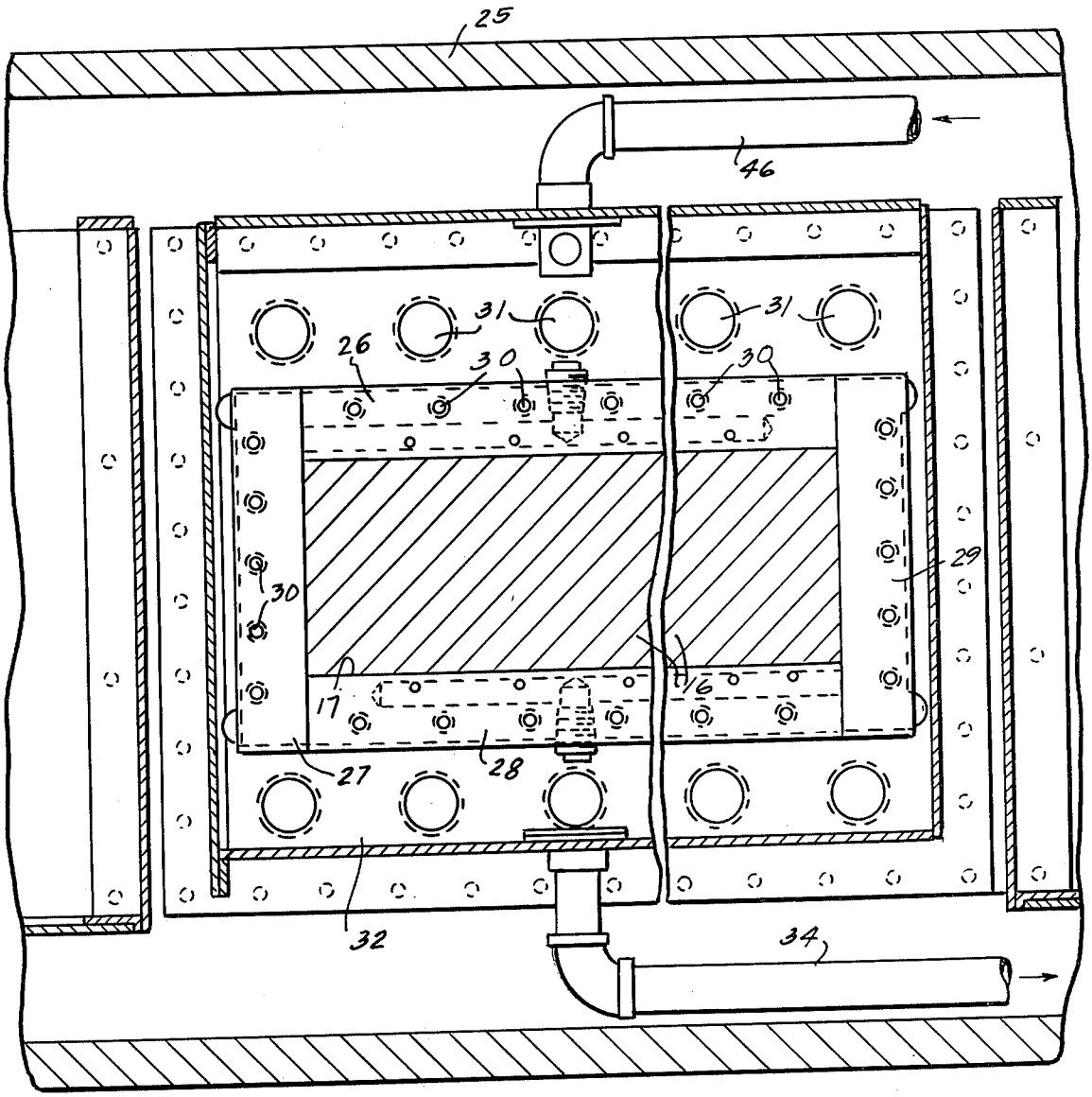
FIG. 2 is a vertical sectional view taken substantially along line II—II of FIG. 1.

Referring now in greater detail to the construction of the extended nip press as shown in FIGS. 1 and 2, the web W passes into first nip on the felt 18 which is supported by felt guide rolls 19*a* and 20*a*.

The pressing belt is an endless one-piece belt formed of rubber or extremely strong synthetic material with cords therein and has belt guide rolls 23 and 24 inside of the looped ends. The portions of belt which pass through the press nips may be regarded as belt elements designated at 12*a* and 12*b*. The belt guide rolls 23 and 24 may preferably be idler rolls, but can be driven. The press nip load on the belts is high, and the idler rolls cannot put in any significant drive power, and further, this occurs on the lubricated side of the belt.

The arrangement for supporting the shoes 11 and 14 within the looped belt includes a framework 25 having a cross frame plate 32 which supports an elongate block 20 having the cylinder 17. The cylinder 17 is rectangular in shape and extends for the width of the machine and has smooth inner walls formed by plates 26, 27, 28 and 29, FIG. 2. These plates are in opposing separate parts and are held together by through bolts 30 to hold them to the frame plate 32, and are joined at their corners to form a rectangular cylinder. The pistons 15 and 16 are rectangularly shaped and are provided with sealing piston rings 15*a* and 16*a*. The shoes 11 and 14 are supported on roll pins 15*b* and 16*b* which are located at the center of force of the shoes so that the shoes are rockable thereon and can assume their natural position and permit a dynamic wedge of lubricating fluid to be formed between the shoe and belt, thus insuring a long operating life. For this purpose, the faces 11*a* and 14*a* of the shoes which face the belt are concave and shaped substantially to the same arc of curvature as the outer surfaces 10*a* and 13*a* of the press rolls. The leading edges 11*b* and 14*b* of each of the shoes is relieved so that lubricating fluid, preferably oil, will form the dynamic wedge beneath the shoe. Actually, this dynamic wedge extends for the length of the shoe, and thus the length of the extended nip so that the belt actually is backed by a film of hydraulic fluid so that the force against the belt at all locations across the full width of the nip is equal and the web passing through the extended nip is subjected to a uniform pressure across the width of the press rolls 10 and 13. This assures uniform dewatering and the amount of water pressed out of the web is uniform across each of the felts 18 and 19. The hydrodynamic pressure is also uniform throughout the length of the extended nip in the direction of web movement. Thus, as the web enters the extended nip, it will be quickly brought up to a predetermined pressing pressure, and this pressure will be maintained throughout the length of the nip and at the trailing edge of the nip, the pressure will suddenly be released. The sudden release diminishes rewetting, and the uniform pressure throughout the extent of the nip in effect acts as a static pressure on the web permitting maximum migration of water from the web into the felt.

The pressurized fluid for exerting the forces on the piston is preferably oil, but may also be water or other suitable fluids, and is delivered at a controlled predetermined pressure through a delivery line 33 which communicates with the chamber 17 between the pistons.

For providing the wedge of hydrodynamic liquid beneath the shoes, delivery spouts or slots 45 and 47 supplied by pipes 44 and 46 extend across the width of the nip directing a continual supply of oil into the gap formed at the relieved edges 11*b* and 14*b* of the shoes.

The area surrounding the shoes is enclosed to prevent oil from passing along with the inner surface of the belt between the belt and the guide rolls 23 and 24 by suitable seals. At the upper side of the area, at the offrunning side of the first shoe 11 are seals 41 which are supported on suitable brackets and are in the form of flexible lips or plastic or rubber slidably engaging the inner surfaces of the belt to skim the oil off the surface of the belt. A similar seal 42 is positioned above the second shoe 14. Lower seals 37 and 38 are positioned at the offrunning side of the second shoe 14, and lower seals 39 and 40 are positioned below the first shoe 11. Oil which drains downwardly is drawn off from the compartment surrounding the shoes by oil removal lines 34 and 35. An additional oil removal line 36 is positioned on the other side of the plate 32, and a further removal line 43 positioned below the seal 39. Pipe plugs 31 are threaded into holes through the plate 32, and these can be removed if communication between the two sides of the plate is desired.

Figure 4:
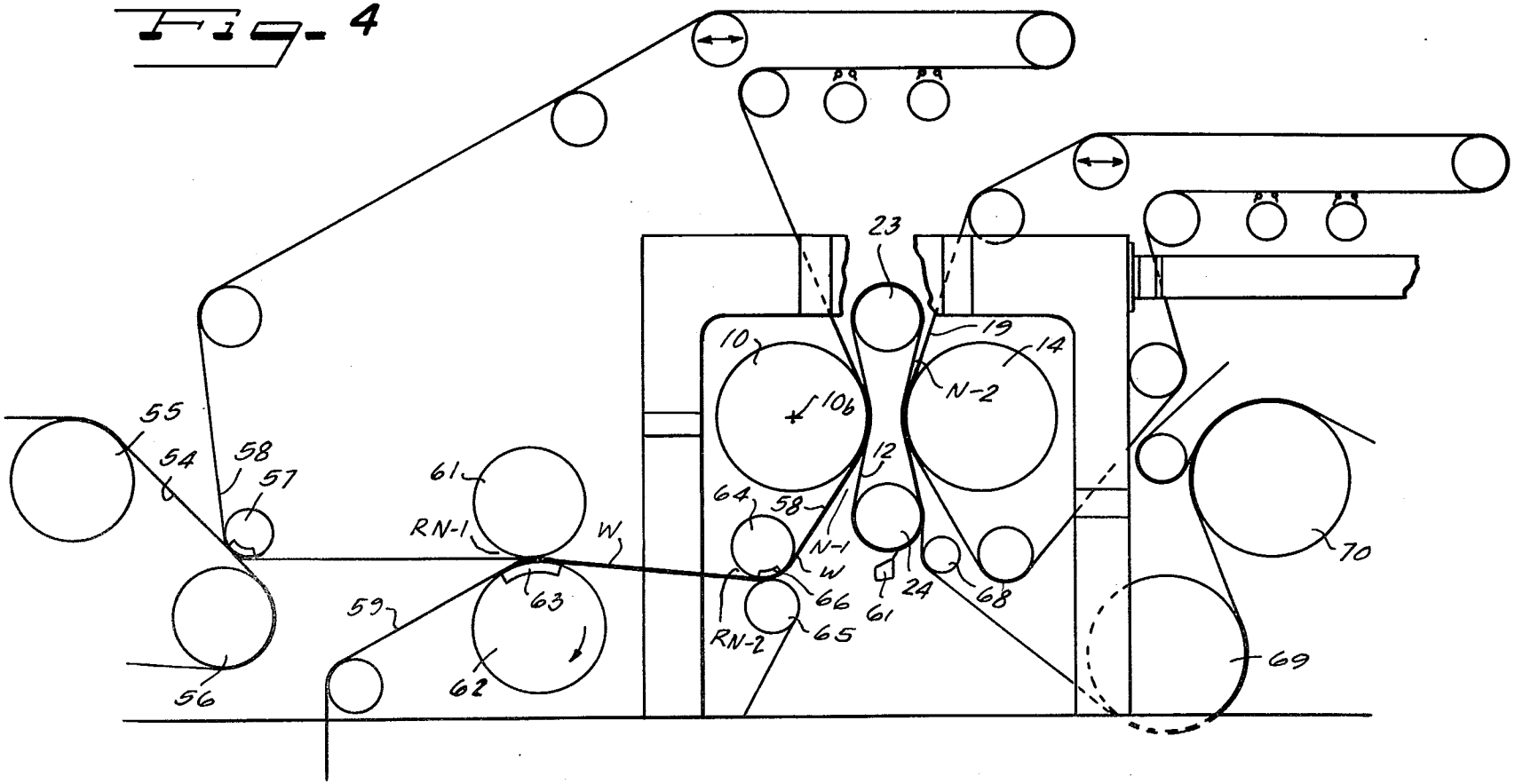
FIG. 4 is a somewhat schematic front elevational view of the press section of a paper making machine.
Figure 5:
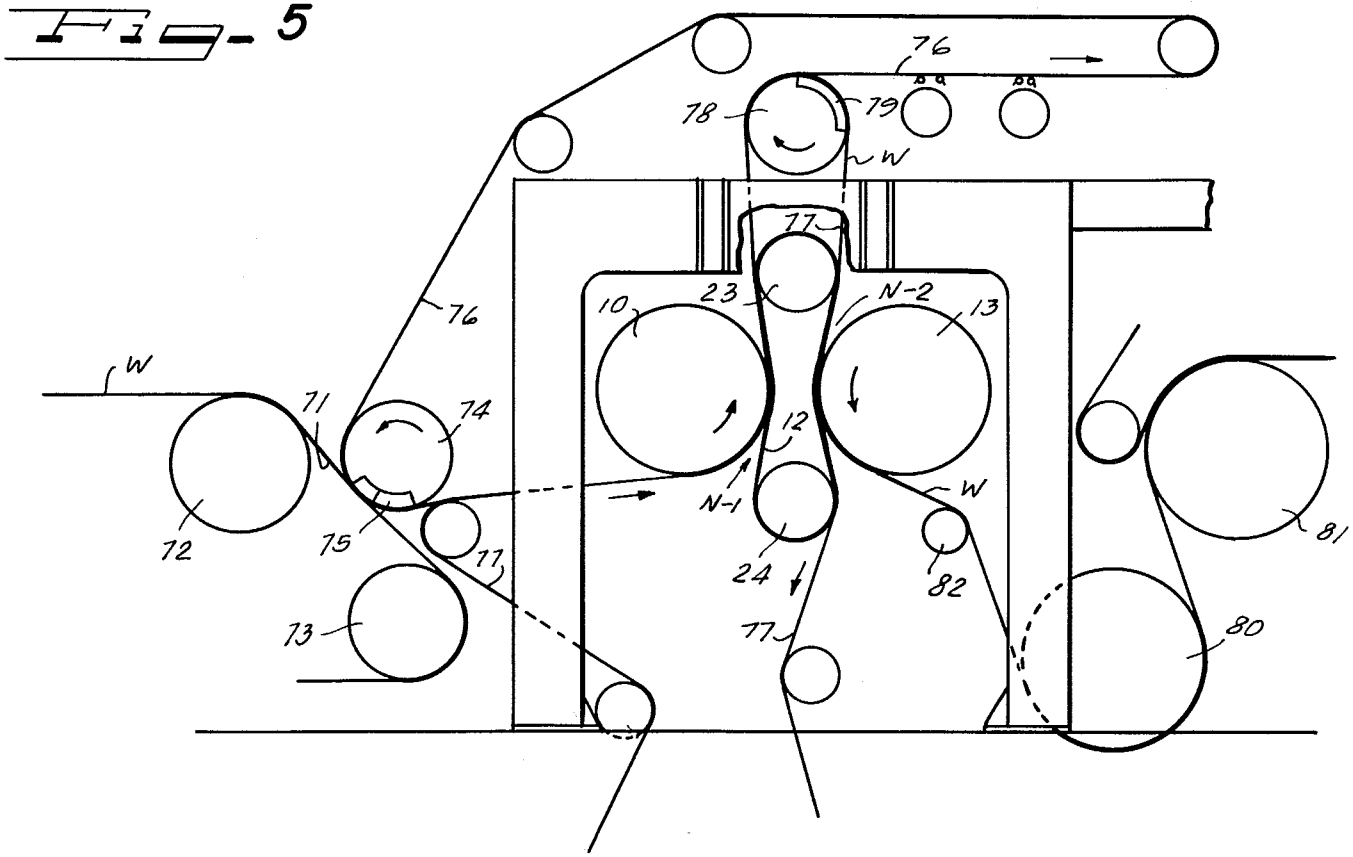
FIG. 5 is a front elevational view of a press section of a paper making machine.

Water removed from the web through the second extended nip N-2 is received by the felt 19 which passes over felt guide rolls 21 and 22, and on the offrunning side of the second nip, the web W follows the belt to be separated therefrom where the belt turns around the guide roll 24, and the web is then led by suitable rolls to the dryer section of the machine in an arrangement such as illustrated in FIGS. 4 and 5.

Figure 3:
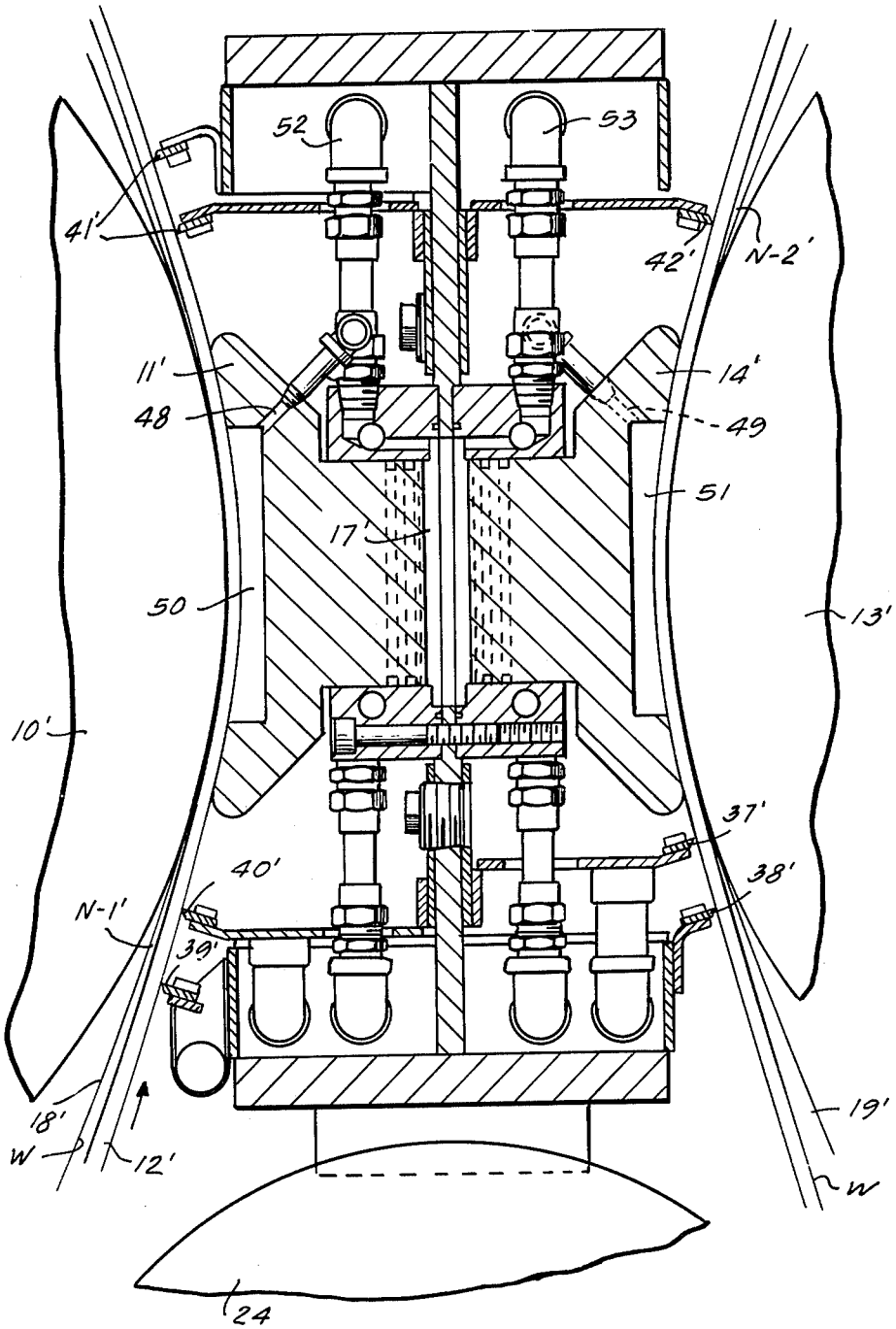
FIG. 3 is another front elevational view with portions in section similar to FIG. 1, but illustrating another form of the invention.

In some circumstances, it may be desirable instead of providing a hydrodynamic wedge of fluid with shoes such as shown in FIG. 1, to provide a static backing pressure for the belt such as illustrated in FIG. 3. In FIG. 3, a belt 12' passes through nips N-1' and N-2' formed between the belt 12' and press rolls 10' and 13'. The web W is carried through the successive nips between the belt 12', and a felt 18' for the first nip N-1' and a felt 19' for the second nip N-2'.

Within the belt 12' are shoes 11' and 14'. These shoes are each provided with a cavity or chamber 50 and 51 respectively in the face thereof, and these chambers are filled with pressurized fluid so that the belt is subjected to the static pressure of the fluid. Fluid such as oil or water may be used, delivered to the chamber 50 through a connector 48 from a supply line 52. Pressurized fluid for the chamber 51 is supplied through a connector 49 from a pressurized supply line 53. The edges of the shoes at the leading and trailing end of the chambers 50 and 51 prevent the free escape of fluid and permit pressure build-up, and the fluid which leaks along the edges of the shoes is removed by piping similar to that shown in FIG. 1. The pressurized fluid for the chambers 50 and 51 may be bled off from the same pressure lines 52 and 53 which supply the chamber 17' between the pistons 11' and 14'.

In the arrangement illustrated, the reaction forces of the shoes against the roll backed web are opposed. In the arrangement shown wherein the pistons are of the same size, it is possible to get different nip pressures between the two nips by varying the nip length or shoe length. For example, if the pressure in the second press N-2 is to be twice that of the first nip N-1, the length of the second shoe is made one-half that of the first shoe. For example, the first press shoe may be 12" long, and the second press shoe 6" long, and where the piston areas are kept equal, the unit pressure against the web in the second nip will be twice that in the first nip.

The mechanism can also be constructed so that individual chambers are provided at 17 instead of a common chamber. Where individual chambers are provided, they can be provided by hydraulic fluid at different pressures, and by separate lines to each of the chambers, the forces applied to each of the shoes can be controlled independently of the other shoe. It is also possible with the arrangement shown to have a common centrally located hydraulic chamber with pistons of different sizes to obtain different total forces applied to the shoes. Where individual chambers are used, or where the pistons are of different sizes, the reaction forces are still opposite, but not equal. In that instance, the supporting framework structure must be constructed heavier to carry the differences in load without excessive bending.

Flexible seals are located positioned in close running contact with the belt, above and below the area of the shoes 11 and 14 with the seals being indicated at 41', 42', above the shoes and at 37' and 38' and at 39' and 40' below the shoes.

FIG. 4 illustrates the extended nip press arrangement which is shown in detail in FIGS. 1 and 2, as used in a paper machine in a structural combination which is found to be advantageous, particularly with relatively wet webs. In the arrangement of FIG. 4, the web W is removed from the forming wire 54 and run through conventional press couples through nips RN-1 and RN-2 and then through the two nips N-1 and N-2 of the extended press arrangement.

In greater detail with respect to FIG. 4, the web W is formed on a traveling forming wire 54 which passes down over a couch roll 55 and a turning roll 56, and the web is picked off the wire by a felt 58 passing over a pickup roll 57. The web is sandwiched between the upper felt 58 and a lower felt 59. The web sandwiched between the two felts passes through a roll nip RN-1 formed between the rolls 61 and 62. The rolls may be grooved rolls or as shown, the lower roll is a suction roll having suction glands 63 therein. The web is carried on the offrunning side of the roll nip RN-1, sandwiched between the lower felt 59 and the upper felt 58 and then passes through nip RN-2 provided by rolls 64 and 65. The felt 58 wraps the upper roll 64 having a suction gland 66 therein to cause the web to follow the upper felt 58 and travel up through the first nip N-1 of the extended press. The lower felt wraps the turning roll 65. The web then follows the belt 12 and passes through the second nip N-2 of the extended press and is taken off the belt following a roll 68 to be led through the dryer section beginning with dryer rolls 69 and 70. Preferred average nip pressure ranges in pounds per square inch are 100 to 500 in RN-1; 100 to 800 in N-1; and 100 to 800 in N-2.

In the arrangement of FIG. 4, excess water is first pressed from the web through the roll nip RN-1 which prepares the web for its treatment in the extended press.

In the arrangement of FIG. 5, a web W is formed on a forming wire 71 which passes over a couch roll 72 and down over a turning roll 73. The web is picked off of the wire by a felt 76 passing over a pickup roll 74 with a suction gland 75 therein and is sandwiched between the felt 76 and a lower felt 77. The web carried between the two felts passes into the first nip of the extended press which is a double felted nip. The extended press is shown schematically with the shoes within the belt being omitted for clarity of illustration, and they are also omitted from the illustration of FIG. 4 for clarity. In FIG. 5, the web travels between the two felts and is transferred to the felt 77 as it passes over a turning roll 78 by the operation of a suction gland 79. The web then is carried downwardly into the second nip N-2 and follows the press roll 13 to pass over a guide roll 82 to the dryer drum section including dryer drums 80 and 81.

We claim as our invention:

1. A press mechanism for removing liquid from a traveling fibrous web, comprising in combination:

a first elongate press nip formed between a traveling belt element and a first press surface movable with the belt element;

a first stationary backing member extending along said elongate nip supporting the belt element and applying a pressing force to the belt element during its travel through the nip urging it toward said first press surface;

means for receiving liquid pressed from the web in said nip;

a second elongate press nip formed between a traveling second belt element and a second press surface movable with the second belt element;

a second stationary backing member opposite said first stationary member and extending along said second elongate nip urging the second belt element toward said second press nip during its travel along the second nip;

a second means for receiving liquid pressed from the web in said second nip;

and force applying means between said first and second backing members applying forces thereto so that the reaction forces of said force applying means are opposed.

2. A press mechanism for removing liquid from a traveling fibrous web constructed in accordance with claim 1:

wherein said first and said second press surfaces are in the form of rotatable rolls on parallel axes.

3. A press mechanism for removing liquid from a traveling fibrous web constructed in accordance with claim 1:

wherein said first and second belt elements are portions of a unitary looped belt with belt guide means on each side of said nips guiding the belt into and out of the nips.

4. A press mechanism for removing liquid from a traveling fibrous web constructed in accordance with claim 3:

wherein said backing members are in the form of shoes with elongate smooth surfaces shaped to conform to the shape of said press surfaces with means for delivering a film of liquid lubricant between the shoe and belt;

and sealing means in close running contact with the belt at each end of the shoes with means for removing the lubricant from the area of the shoes retained by the sealing means.

5. A press mechanism for removing liquid from a traveling fibrous web constructed in accordance with claim 1:

wherein said first and said second stationary backing members are each in the form of a shoe having an elongate surface in sliding engagement with the belt elements and contoured to the shape of said press surfaces.

6. A press mechanism for removing liquid from a traveling fibrous web constructed in accordance with claim 5:

wherein said force applying means is in the form of opposed pistons each with a fluid pressure backing chamber with the pistons pivotally supporting the shoes and urged in a direction to apply the backing force to said backing members.

7. A press mechanism for removing liquid from a traveling fibrous web constructed in accordance with claim 6:

wherein the fluid chamber for each of the pistons is a common chamber with fluid acting on both of said pistons.

8. A press mechanism for removing liquid from a traveling fibrous web constructed in accordance with claim 1:

wherein said means for receiving liquid is in the form of a looped felt and said second means for receiving liquid is in the form of a looped felt.

9. A press mechanism for removing liquid from a traveling fibrous web constructed in accordance with claim 1:

wherein said stationary backing members are in the form of shoes with smooth belt element contacting surfaces shaped to conform to the shape of the press surfaces and having a relieved leading edge:

and means for delivering a lubricating liquid to each relieved leading edge to form a hydrodynamic wedge between each shoe and belt element.

10. A press mechanism for removing liquid from a traveling fibrous web constructed in accordance with claim 1:

wherein each of said backing members has a hollow chamber faciing the belt element;

and means for delivering a pressurized fluid to the chamber with said fluid providing a hydraulic pressure to the belt element along the extent of said elongate nips.

11. A press mechanism for removing liquid from a traveling fibrous web constructed in accordance with claim 1:

including a first roll press nip formed between a pair of opposed press rolls;

and carrier means for transporting a wet web from a forming member to said first roll press nip; said web traveling from the first roll press nip to said first elongated press nip.

12. A press mechanism for removing liquid from a traveling fibrous web constructed in accordance with claim 11:

wherein said belt elements are provided by a looped endless traveling belt with guide members for the belt at the ends of the nips and with said press surfaces formed by parallel rotating rolls with said stationary backing members being in opposing back-to-back relationship so that reaction forces of the force applying means are cancelled.

13. The method of removing liquid from a traveling fibrous web by applying pressing forces to the web comprising the steps:

passing a relatively wet web on a carrier felt through a first press nip formed between a pair of rolls;

immediately passing the web following the first nip through a second, elongate extended nip;

immediately after the second nip passing the web around a roller and through a third, elongate extended nip spaced from said second nip; and simultaneously applying opposed pressures in said second and third nips from a force between the nips to different portions of said web respectively received in said second and third elongate nips with the pressure remaining substantially constant throughout each nip and releasing the pressure at the end of said nips, whereby the force is such that any reaction forces are opposed.

14. The method of removing liquid from a traveling fibrous web by applying pressing forces to the web in accordance with the steps of claim 13:

wherein the pressing applied in the first nip is in the range of 100 to 500 pounds per square inch.

15. The method of removing liquid from a traveling fibrous web by applying pressing forces to the web in accordance with the steps of claim 13:

wherein the pressure in the second and third nips is in the range of 100 to 800 pounds per square inch throughout the extent of the nips.

16. A press mechanism for removing liquid from a traveling fibrous web comprising in combination:

a looped endless press belt;

first and second guide rolls in the ends of the press belt;

first and second press rolls positioned between the guide rolls and pressing into said belt to form first and second nips;

a first press felt for carrying a web through the first nip between the belt and felt with the web following the belt on the offrunning side of the first nip and passing through the second nip on the belt;

a second felt passing through the second nip with the web between the belt and second roll;

opposed first and second backing shoes in sliding relation with the inner surface of said belt along the extent of said first and second nips with said shoes having an inner surface essentially conforming to the curvature of the press rolls;

opposed pistons between said shoes, pivotal connections between said pistons and each of said shoes respectively;

a fluid pressure chamber slidably receiving said pistons with means for directing a fluid under pressure between the pistons so that the forces applied to the pistons are equal and opposite;

lubricating fluid dams at each side of the nips retaining the lubricating fluid within the area of said shoes;

means for delivering lubricating fluid to relieved noses on each of the shoes;

and means for removing excess lubricating fluid from between said dams.

17. A press mechanism for removing liquid from a traveling fibrous web comprising in combination:

a first felt receiving a web from a forming section of a paper making machine;

a second felt guided against the web so that the web is sandwiched between the two felts;

a first elongate press nip receiving said first and second felts and formed between a press roll and a traveling belt wrapped over the press roll;

a first shoe urging the belt toward the roll to form an extended nip;

guide means separating the first felt from the second felt;

a second nip receiving the second felt with the web thereon and formed between a second press roll and the belt;

a second shoe within the belt urging the belt toward the second roll forming an extended pressure nip therebetween;

first and second fluid backing members acting respectively on said first and second shoes and positioned between the shoes so that their reactive forces are in opposition;

and means for guiding the web rom the offrunning side of the second extended nip.

* * * * *

UNITED STATES PATENT AND TRADEMARK OFFICE

CERTIFICATE OF CORRECTION

PATENT NO. : 4,201,624

DATED : May 6, 1980

INVENTOR(S) : William C. Mohr, Leroy H. Busker, Carl J. Francik & Jan I. Bergstrom It is certified that error appears in the above-identified patent and that said Letters Patent are hereby corrected as shown below:

Column 8, line 33, after "pressing", insert --pressure--.

Signed and Sealed this

*Thirtieth* Day of *September 1980*

[SEAL]

*Attest:*

SIDNEY A. DIAMOND

*Attesting Officer*

*Commissioner of Patents and Trademark.*